US006866125B2

(12) United States Patent
Ball et al.

(10) Patent No.: US 6,866,125 B2
(45) Date of Patent: Mar. 15, 2005

(54) ILLUMINATION SYSTEM FOR ESCALATOR HANDRAILS

(75) Inventors: Ronald Ball, Oshawa (CA); George Yan, North Augusta (CA)

(73) Assignee: Ronald H. Ball, Oshawa (CA)

( * ) Notice: Subject to any disclaimer, the term of this patent is extended or adjusted under 35 U.S.C. 154(b) by 0 days.

(21) Appl. No.: 09/948,622

(22) Filed: Sep. 10, 2001

(65) Prior Publication Data

US 2002/0036121 A1 Mar. 28, 2002

Related U.S. Application Data

(60) Provisional application No. 60/231,302, filed on Sep. 8, 2000.

(51) Int. Cl.[7] ..... B66B 7/00

(52) U.S. Cl. ..... 187/391; 187/413; 198/335

(58) Field of Search ..... 187/391, 413, 187/353, 414; 362/551, 553, 555, 146; 198/335–338, 324

(56) References Cited

U.S. PATENT DOCUMENTS

| | | | | | |
|---|---|---|---|---|---|
| 2,479,500 | A | * | 8/1949 | Longberg | 362/146 |
| 3,740,541 | A | * | 6/1973 | Conradt | 362/146 |
| 4,896,759 | A | * | 1/1990 | Badstuebner et al. | 198/324 |
| 5,020,256 | A | * | 6/1991 | French | 40/584 |
| 5,067,062 | A | * | 11/1991 | Rulke | 198/337 |
| 5,099,402 | A | * | 3/1992 | Starniri | 362/146 |
| 5,339,228 | A | * | 8/1994 | Baethge et al. | 198/337 |
| 5,613,758 | A | * | 3/1997 | Kamschal et al. | 362/146 |
| 6,030,108 | A | * | 2/2000 | Ishiharada et al. | 362/101 |
| 6,129,442 | A | * | 10/2000 | Hoefling et al. | 362/146 |

FOREIGN PATENT DOCUMENTS

| | | | | |
|---|---|---|---|---|
| CA | 2312041 | | 6/2000 | |
| DE | 4209505 | C1 * | 7/1993 | B66B/23/22 |
| JP | 62-157876 | | 10/1987 | |
| JP | 2000 103585 | | 4/2000 | |
| JP | 2000 103585 | | 9/2000 | |
| WO | WO-97 15520 | | 5/1997 | |

OTHER PUBLICATIONS

PCT International Search Report, PCT/CA01/01282 filed Sep. 7, 2001

* cited by examiner

*Primary Examiner*—Jonathan Salata
(74) *Attorney, Agent, or Firm*—Bereskin & Parr

(57) ABSTRACT

An illumination system for an escalator handrail has a rechargeable power source and a light source. The rechargeable power source is recharged by a charging circuit which receives power from one or more magnetically coupled charging stations. The light source emits light into an optic fiber or another light carrying and dispersing element. The optic fiber is selected to disperse light from its sides and thereby appears to be illuminated.

27 Claims, 6 Drawing Sheets

ILLUMINATION SYSTEM FOR ESCALATOR HANDRAILS

FIELD OF THE INVENTION

This invention relates to handrails for escalators. More particularly, the invention relates to escalator handrails that are illuminated.

BACKGROUND OF THE INVENTION

Escalator systems with moving handrails are well known. In many of these systems, the handrail is a rubberized or thermoplastic element which travels at an appropriate height above and adjacent to a moving escalator. Typically, the handrail is solid black or another monochromatic color.

Such monochromatic handrails may be difficult for some persons to see, particularly when ambient lighting conditions are poor. Furthermore, the surface of such handrails presents a potential surface for advertising, for the presentation of safety information, or for the presentation of a graphic design.

It is accordingly desirable to provide an illuminated handrail for an escalator. Such a handrail will be more visible to persons with visual impairments. Preferably, although not necessarily, the illumination system may be adapted to present a safety or advertising message or a graphic design to users of the escalator.

SUMMARY OF THE INVENTION

In one embodiment, the present invention provides an illumination system for an escalator handrail. The illumination system comprises a light source powered by a power source which may be a rechargeable battery. The light source may directly provide the illumination for the system or it may emit light into a light dispersing element such as an optical fiber or a plastic sheet. If the power source is a rechargeable battery, a charging circuit may be coupled to it to maintain the battery's charge. The charging circuit is magnetically coupled to one or more charging stations as the handrail travels around its loop and at each charging station, the charging circuit will receive an electromagnetic power signal from the charging station. The charging circuit converts this electromagnetic power signal into a charging signal which is used to charge the battery.

In another embodiment of an illumination system according to the present invention, an escalator handrail includes an optic fiber embedded into it adjacent its surface. A light source positioned adjacent the optic fiber injects light into the optic fiber. This injected light travels along the length of the fiber and is emitted from the side of the fiber, causing the fiber to appear illuminated.

In another embodiment of the present invention, one or more light sources are mounted beneath a handrail. The handrail may be transparent, allowing the light from the light sources to be seen from a top surface of the handrail. The light sources may be oriented to display text messages or graphics, which may be either static or moving. If the messages are moving, their motion may be synchronized to the motion of the handrail or the steps of the escalator. Alternatively, the handrail may be translucent so that it absorbs, diffuses and emits light incident upon it. Such a translucent handrail appears to be lit up internally, although, in fact, the light sources are external to the handrail.

In one aspect, the present invention provides an illumination system for a handrail, said illumination system comprising: a light source mounted onto or within said handrail; and a power source coupled to said light source.

In another aspect, the present invention provides an illumination system for a handrail comprising: an optic fiber mounted to said handrail; and a light source for injecting light into said handrail.

In yet another aspect, the present invention provides an illumination system for a handrail comprising a light source oriented to direct light onto a bottom surface of said handrail. In this aspect, the handrail may be transparent or translucent.

BRIEF DESCRIPTION OF THE DRAWINGS

Several exemplary embodiments of the present invention will now be described with reference to the drawings, in which.

DETAILED DESCRIPTION OF THE PREFERRED EMBODIMENTS

Figure 1:
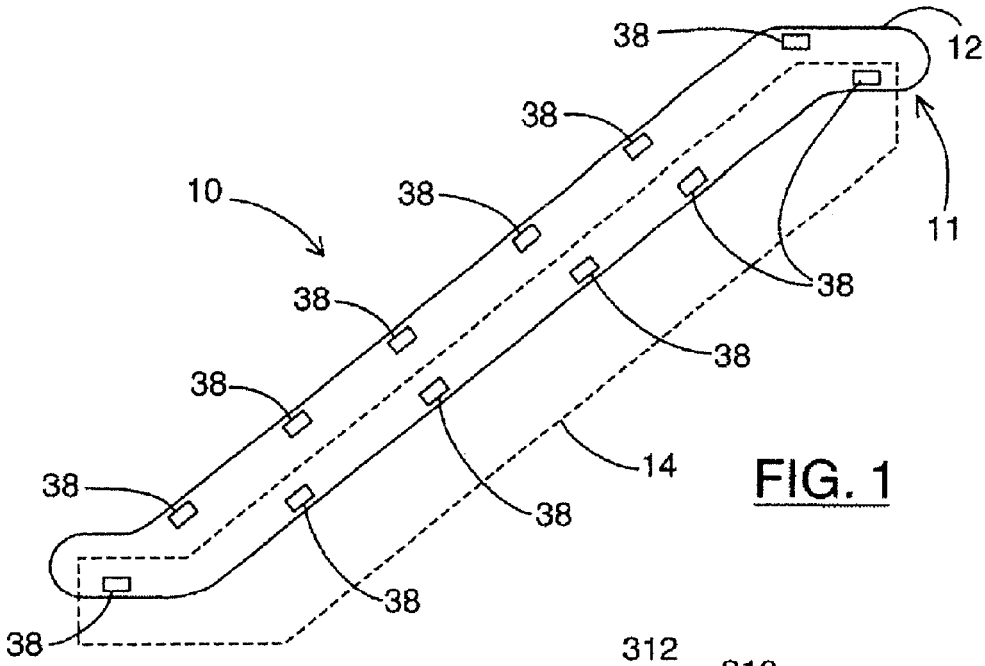
FIG. 1 is a side elevational view of a first illumination system according to the present invention.

Reference is first made to FIG. 1 which illustrates a handrail illumination system 11 for an escalator 10. Handrail illumination system 11 comprises a handrail 12 and plurality of charging stations 38. Handrail 12 forms a closed loop and moves along the closed path illustrated in FIG. 1 in conjunction with a set of steps (not shown) of escalator 10. During its travel, handrail 12 is enclosed within the body of escalator 10 when it is in the portion of the path enclosed within dotted outline 14. As handrail 12 moves along the closed path, each point of handrail 12 passes every charging station 38.

Figure 2:
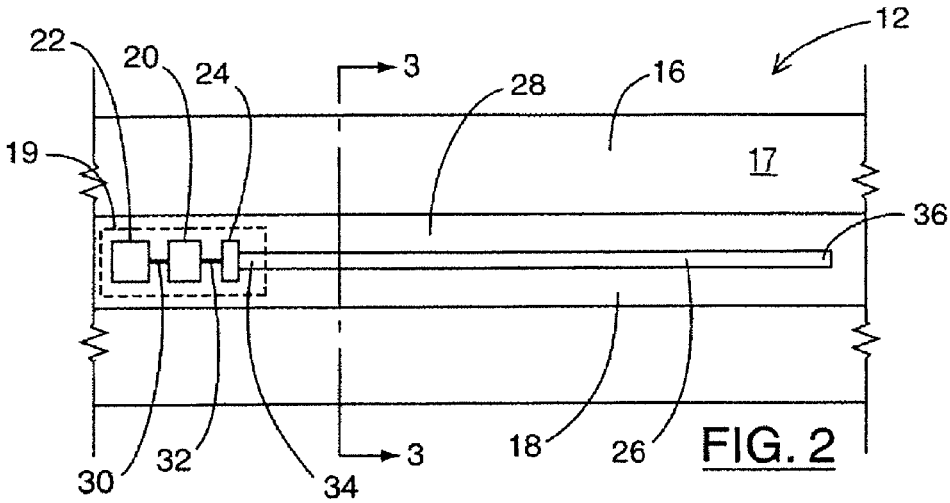
FIG. 2 is a top view of a handrail which forms part of the illumination system of FIG. 1.
Figure 3:
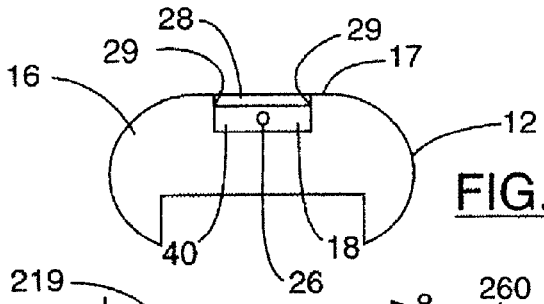
FIG. 3 is a sectional view of the handrail of FIG. 2.

Reference is next made to FIGS. 2 and 3, which illustrate handrail 12 in greater detail. Handrail 12 comprises a base 16, a channel 18, a power/lighting block 19, an optic fiber 26 and a protective cover 28. Power/lighting block 19 comprises a power source 20, a charging circuit 22 and a light emitter 24.

Base 16 may be formed from any elastomeric material suitable for an escalator handrail. For example, base 16 may be formed of rubber or a thermoplastic material. During the fabrication of base 16, channel 18 is formed in a top surface 17 of handrail 12. Power source 20 may be a battery or rechargeable battery. In the preferred embodiment of handrail 12, power source 20 is a rechargeable battery. Power source 20 is coupled to a charging circuit 22 by means of a coupling 30, which may be one or more wires. Charging circuit 22 maintains the charge of power source 20 as described below. Power source 20 is coupled to light emitter 24 by means of a coupling 32 which may be one or more wires. Light emitter 24 may be a small laser device or one or more diodes or any other light source which emits visible light. Light emitter 24 is coupled to optic fiber 26 such that the visible light emitted by light emitter 24 is projected into a proximal end 34 of optic fiber 26. Light emitter 26 transmits this light signal down its length to its distal end 36. Optic fiber 26 is selected so that light transmitted by light emitter 24 from the proximal end 34 to the distal end 36 of optic fiber 26 will be dispersed from the sides of optic fiber 26 along its length, and in particular will be dispersed through the top 17 of handrail 12. For example, optic fiber 26 may be comprised of a homogenous material along its length or may comprise an inner core and a cladding having different refractive indexes selected so that light transmitted down the core of optic fiber 26 will be refracted out of optic fiber 26.

Protective cover 28 is transparent or is at least translucent and covers the length of channel 18. Protective cover 28 is sealed at its edges 29 to base 16 forming a cavity 40 defined by the walls of channel 18 and protective cover 28. Charging circuit 22, power source 20, light emitter 24 and optic fiber 26 are contained within cavity 40.

The length of optic fiber 26 will be dependent on the distance over which it appears to be illuminated when light source 24 is operational. This in turn will depend on the intensity of light emitted by light source 24 and the light dispersing characteristics of optic fiber 26. A person skilled in the art will be capable of selecting an appropriate optic fiber 26 (or other material) for use in conjunction with the selected light source 24 and will be capable of determining an appropriate length for optic fiber 26.

Referring again to FIG. 1, charging stations 38 are spaced along and adjacent to the path of handrail 12. Each charging station 38 is a circuit (not shown) configured to provide an electromagnetic power signal to charging circuit 22 as charging circuit 22 passes the particular charging station 38. Charging circuit 22 receives this electromagnetic power signal and converts it into an electric power signal which it uses to then charge power source 20 via power coupling 30. Charging circuit 22 will be electromagnetically coupled to each charging station 38 as it travels along its path. Both charging circuit 22 and charging stations 38 may include a coil (not shown). The coils of the charging circuit 22 and charging stations 38 may be shaped to increase the electromagnetic coupling between the charging circuit 22 and a charging station in order to increase the power transfer between them.

The power received by charging circuit 22 and the power stored in power source 20 by charging circuit 22 will depend on the strength of the electromagnetic coupling and on the amount of power transferred during the effective period of coupling. The spacing of charging stations 38 and the power transferred during each coupling between charging circuit 22 and a charging station 38 will be selected so that power source 20 is kept sufficiently charged to power light source 24.

Reference is made to FIG. 2. Charging circuit 22, power source 20 and light source 24 are shown as distinct units coupled together by couplings 30 and 32. In an alternative embodiment of an illumination system according to the present invention, charging circuit 22 and power source 20 and light source 24 may be combined so that a single integrated unit comprises all three elements. Such an integrated unit may appear smaller than three distinct units and may present a more attractive appearance from the top of handrail 12.

Figure 4:
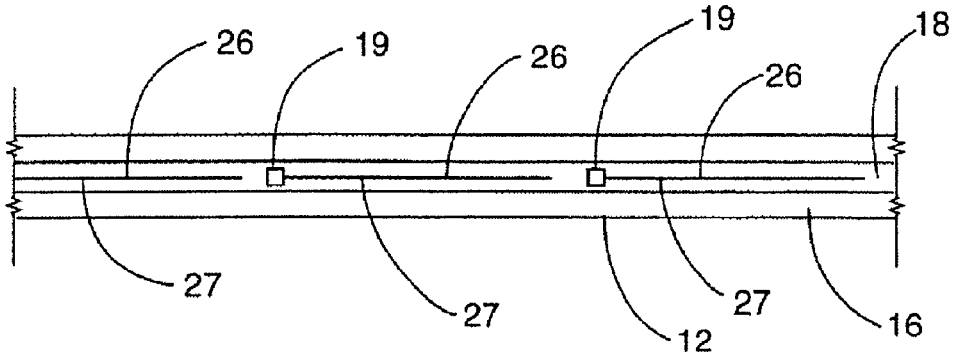
FIG. 4 is another top view of the handrail of FIG. 2.

Reference is next made to FIG. 4. The length of optic fiber 26 will be selected as described above. Typically, to illuminate the entire length of handrail 12, a number of optic fibers 26 may be positioned end to end. FIG. 4 illustrates a longer section of handrail 12 than was illustrated in FIG. 2 and shows a number of illumination units 27 comprising an optic fiber 26 and a power/light block 19. Each of the illumination units operates separately and each of them receives power from the charging stations 38 (FIG. 1) as the charging circuits 22 of the power/light blocks 19 pass by the respective charging station. As shown, a plurality of illumination blocks may be positioned in a linear arrangement to provide illumination of all or substantially all of the handrail.

Optic fiber 26 need not be positioned in a straight line but may be configured to show a graphic design or may be configured to display an alphanumeric message. Furthermore, sections of optic fiber 26 may be covered by an opaque material so as to create a more complex pattern or to separate letters in an alphanumeric message. In addition, two or more optic fibers 26 may receive light from a single light source 24 and may be combined to form a longer or more complex message or design. Furthermore, power source 20 may be used to power two or more light sources 24, possibly of different colors. Each light source 20 may provide light to one or more optic fibers 26, which may be combined to form a design or alphanumeric message.

Reference is again made to FIG. 3. Cavity 40 may be left empty or may be filled with a flexible and transparent gel or other material which allows light emitted by optic fiber 26 to be seen from the top of handrail 12.

Figure 5:
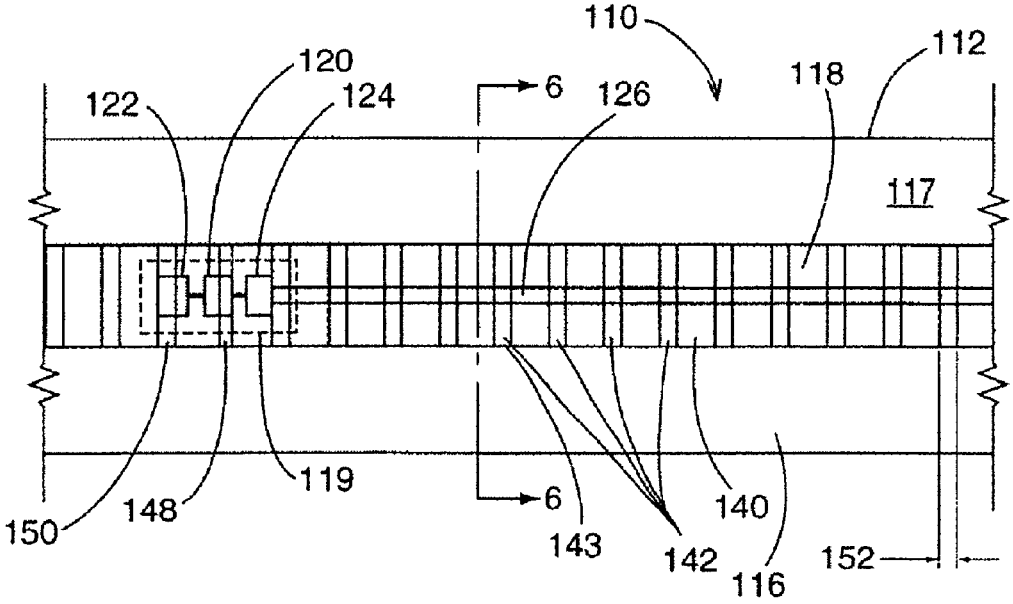
FIG. 5 is a top view of a handrail of a second illumination system according to the present invention.
Figure 6:
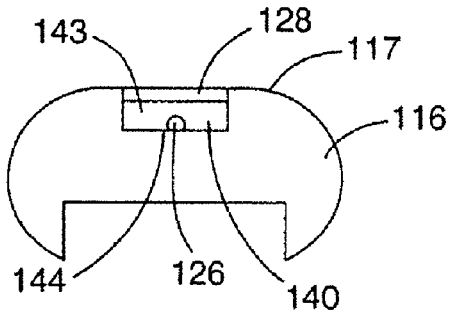
FIG. 6 is a sectional view of the handrail of FIG. 5.

Reference is next made to FIGS. 5 and 6 which illustrate a second embodiment of an escalator handrail 112 which is part of a second illumination system 111 according to the present invention. Illumination system 111 includes charging stations 138 (not shown) which are identical to charging stations 38. Elements of escalator handrail 112 which correspond to escalator handrail 12 are given the same reference numerals increased by 100. As is known, the movement of an escalator handrail is generally controlled by mechanical devices such as pinch rollers and motors which can exert substantial forces on the handrail. If in a particular embodiment of an escalator handrail according to the present invention, such pinch rollers and other mechanical devices would exert too great a mechanical compression force so as to cause cover 28, optic fiber or power/light block 19 to become damaged, then protective elements may be installed in cavity 40.

Escalator handrail 112 is identical to escalator handrail 12 except for the use of protective shells 142. Protective shells 142 are spaced apart longitudinally in channel 118 within cavity 140. Cover 128 is affixed above protective shells 142. When handrail 112 is subjected to mechanical forces of pinch rollers and other mechanical components of an escalator, protective shells 142 will prevent cover 128 from being forced into cavity 140 and from separating from base 116 or from compressing and damaging optic fiber 126.

A particular protective shell 143 may correspond to the shape of cavity 140 and may have a notch 144 to accommodate optic fibers 126. Protective shells 148 and 150 which are positioned over power source 120 and charging circuit 122 will have appropriately shaped notches to accommodate those elements inside cavity 140.

Protective shells 142 are shown spaced along channel 118. In another embodiment of a handrail according to the present invention, protective shells 142 may be placed alongside one another so that they provide a continuous protective support for optic fiber 126 and the components of power/light block 119. The width 152 of protective shells 142 is selected so that handrail 112 remains flexible along its path as part of escalator 110 (not shown). Any spaces between protective shells 142 may be filled with an optically transparent gel or other material which renders the edges between protective shells 142 transparent or more difficult to view through the top 117 of handrail 112.

Figure 7:
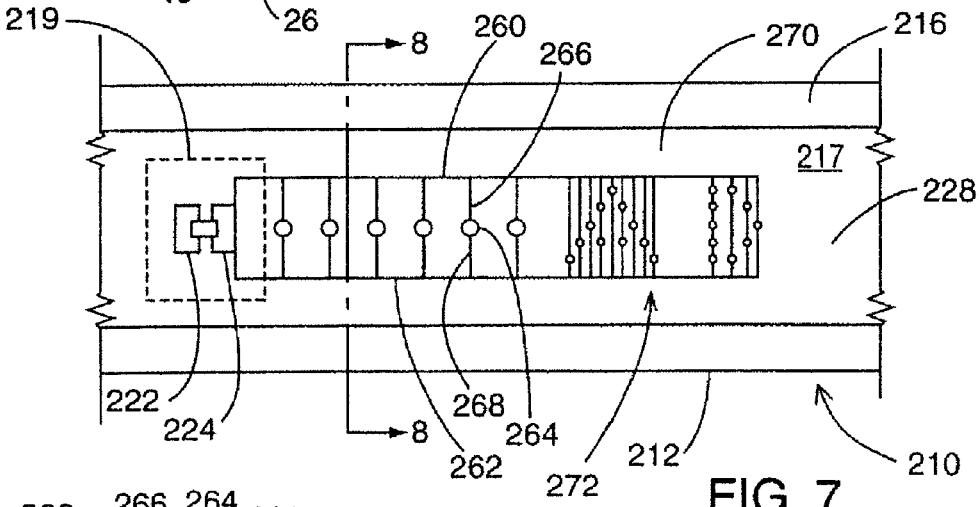
FIG. 7 is a top view of a handrail of a third illumination system according to the present invention.
Figure 8:
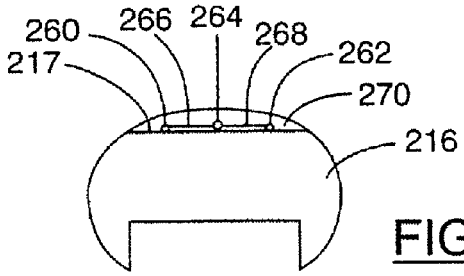
FIG. 8 is a sectional view of the handrail of FIG. 7.

Reference is next made to FIG. 7 which illustrates a third embodiment of a handrail 212 which is part of an illumination system 211 according to the present invention. Illumination system 211 includes charging stations 238 (not shown) which are identical to charging stations 38. Elements of handrail 212 which correspond to elements of handrail 12 are given similar reference numerals increased by 200. Handrail 212 comprises a base 216, a power block 219, power rails 260 and 262 and a plurality of light sources 264 and a cover 270.

Base 216 does not have a channel like channel 18 of handrail 12. Power block 219 comprises a charging circuit 222 and a power source 224, which operate in the same manner as charging circuit 22 and power source 24. Charging circuit 222 receives power from charging stations (not shown) identical to charging station 38. Charging circuit 222 and power source 224 are mounted on the top 217 of base 216. Power source 224 is coupled to power rail 260 and 262 which respectively carry positive and negative (or power and ground) power signals from power source 224. Each light source 264 is coupled between power rails 260 and 262 by means of conductors 266 and 268 to receive power from power rails 260 and 262. A cover 270 is mounted over power block 219, power rails 260, 262 and light sources 264 to protect them during usage of handrail 212. Cover 270 is sealed to top 217 of base 216. If necessary, protective shells similar to protective shells 142 may be mounted between cover 270 and base 216 to protect power block 219 and/or light sources 224.

Light sources 264 are selected to emit visible light and may be selected to emit visible light of different colors. More than one light source may be coupled in parallel between power rails 260, 262 and the spacing between adjacent light sources 264 may be varied to form letters or another pattern, as shown at 272, where a plurality of light sources are arranged to display the word "AD".

In this way, handrail illumination system 211 provides an embedded signboard which may be used to display advertising, safety information or a graphic design on handrail 212.

Figure 9:
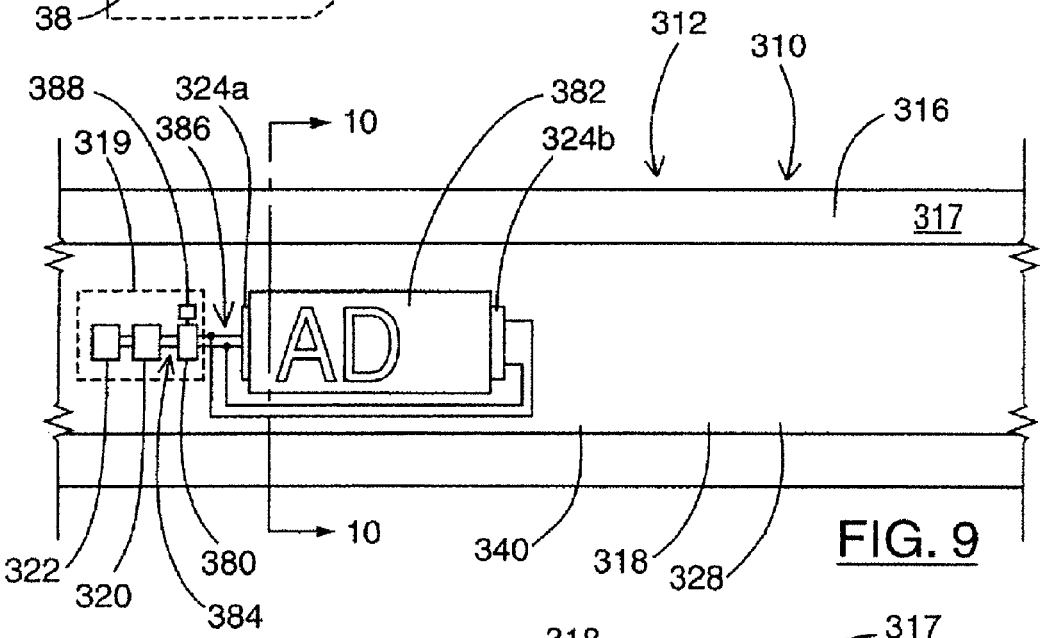
FIG. 9 is a top view of a handrail of a fourth illumination system according to the present invention.
Figure 10:
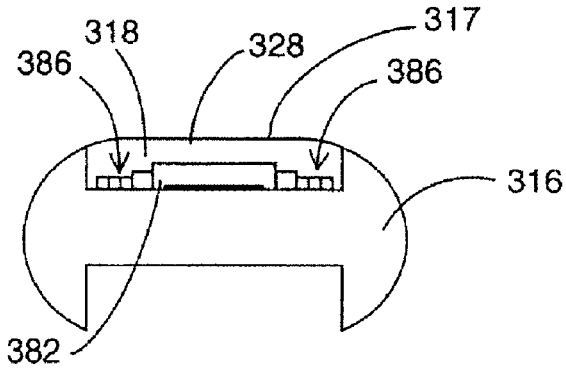
FIG. 10 is a sectional view of the handrail of FIG. 9.

Reference is next made to FIG. 9, which illustrates a fourth embodiment of a handrail 312 which is part of an illumination system 311 according to the present invention. Illumination system 311 includes charging stations 338 (not shown) which may be identical to charging stations 38. Elements of handrail 312 which correspond to elements of handrail 12 are given similar reference numerals increased by 300. Handrail 312 comprises a base 316, a power/lighting control block 319 and a display board 382. Power/lighting control block 319 includes power source 320, charging circuit 322, a pair of light sources 324*a* and 324*b*, a microcontroller 380 and a position detector 388. Microcontroller 380 is coupled to power source 320 through a coupling 384, which may be one or more wires, to receive power and is coupled to light sources 324*a* and 324*b* through coupling 386, which may be one or more wires, to control their operation. Microcontroller 380 is coupled to position detector 388 through a coupling 390, which may be one or more wires.

Display board 382 may be a flexible plastic sheet which has been scored or etched on one or both sides. Display board 382 is selected so that light transmitted into a side of display board 382 is dispersed through the top 317 of handrail 312 at the location of the scores or etchings on display board 382. In this exemplary embodiment, display board 382 has been etched on its bottom surface with the letters "AD".

Light sources 324*a* and 324*b*, which may include one or more LEDs, are mounted on either side of display board 382. Light sources 324*a* and 324*b* transmit light into the edges of display board 382 and this light is dispersed through the top 317 of handrail 312 when it strikes the etched portions of display board 382.

In an alternative embodiment of a handrail according to the present invention, the etched portions of display board 382 may be painted with photo-luminescent paint to enhance to the dispersion of light. Alternatively, display board 382 may not be etched at all and a design or message may be painted onto its top or bottom surface using photo-luminescent paint. This may be particularly desirable where display board 382 is a thin plastic sheet or film and is not suitable for etching or scoring.

Microcontroller 380 controls the power supply to light sources 324*a* and 324*b* to controllably switch them on or off. Microcontroller 380 is also coupled to a position detector 388. Position detector 388 provides a signal to microcontroller 380 indicating whether it is within the enclosed portion 314 of escalator 310 (not shown, but see element 14 on FIG. 1). Microcontroller 380 is responsive to this signal and may switch light sources 324*a* and 324*b* off when they are not visible from the exterior of escalator 310, thereby reducing the power requirements of illumination system 311, and possibly reducing the required number of charging stations 338 (not shown). Position detector 388 may be a photo-diode which is sensitive to the presence or absence of ambient light to determine its position.

The use of two light sources 324*a* and 324*b* at opposite sides of display board 382 is only exemplary. In alternative embodiment, only a single light source may be used, or two or more light sources may be mounted one any side or edge of display board 382, which may not be rectangular.

Microcontroller 380 and position detector 388 may be adapted for use with illumination system 11, 111 or 211. In particular, such a microcontroller may be advantageously used with illumination system 211 to selectively turn on different light sources 224 to provide a dynamic (i.e. time-varying) message or graphic image.

Figure 11:
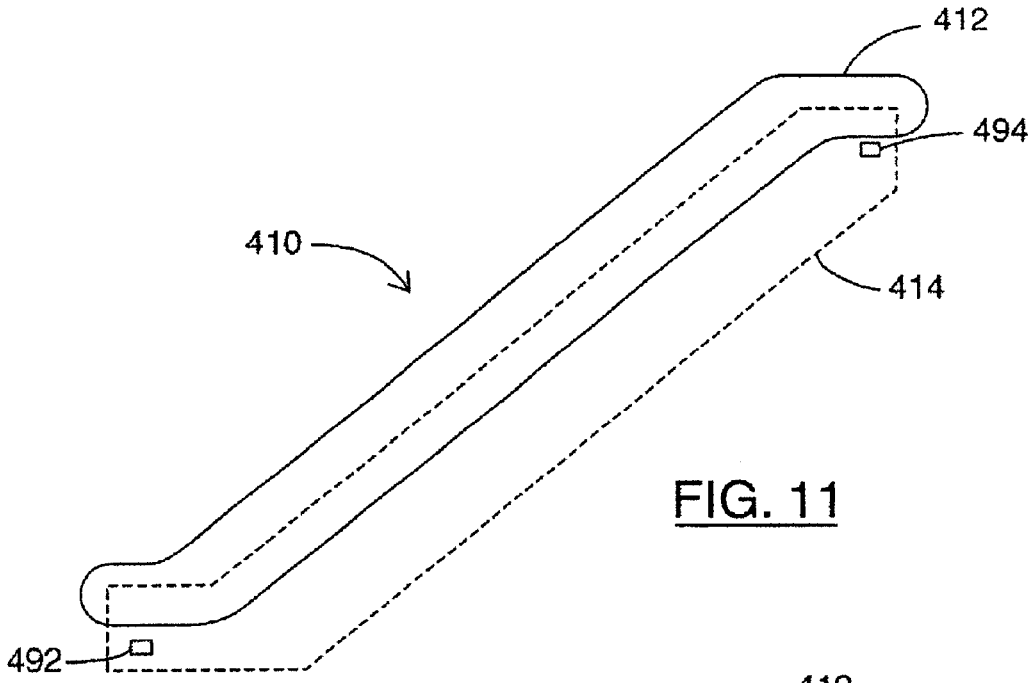
FIG. 11 is a side elevational view of a fifth illumination system according to the present invention.
Figure 12:
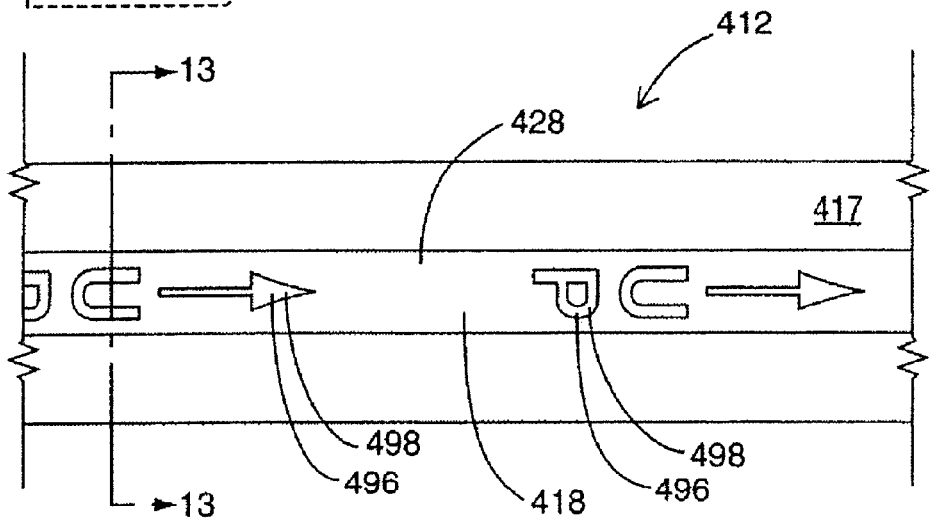
FIG. 12 is a top view of a handrail which forms part of the illumination system of FIG. 11.
Figure 13:
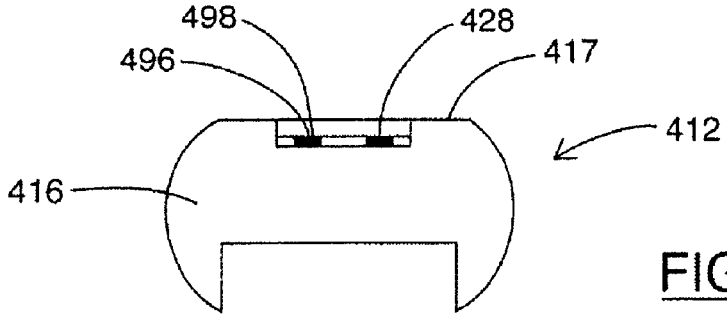
FIG. 13 is a sectional view of the handrail of FIG. 12.
Figure 14:
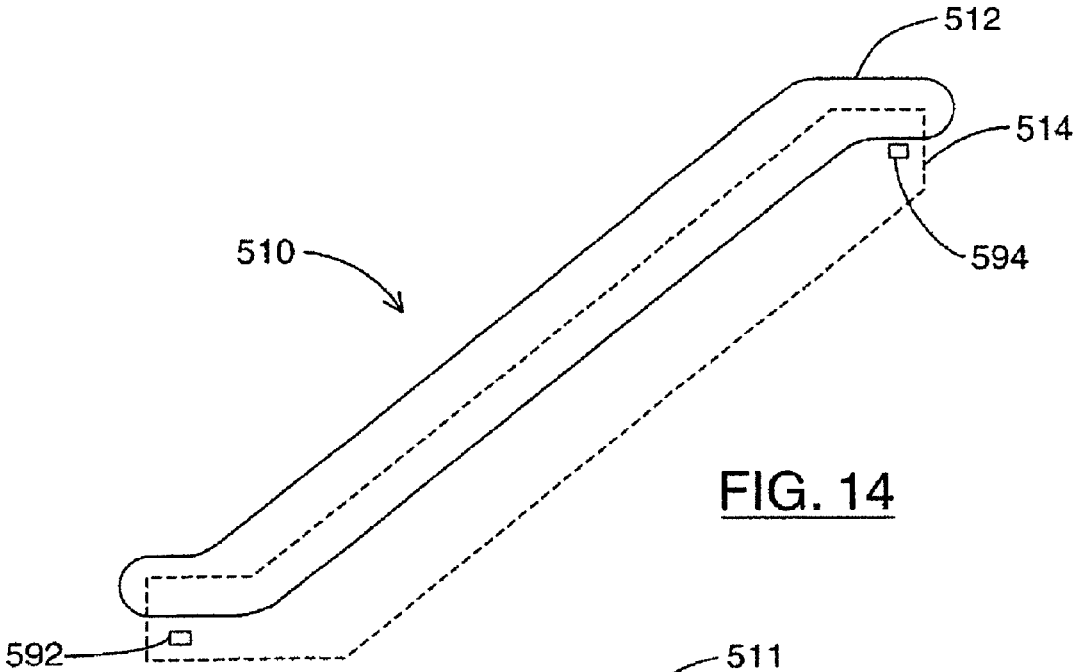
FIG. 14 is a side elevational view of a sixth illumination system according to the present invention.
Figure 15:
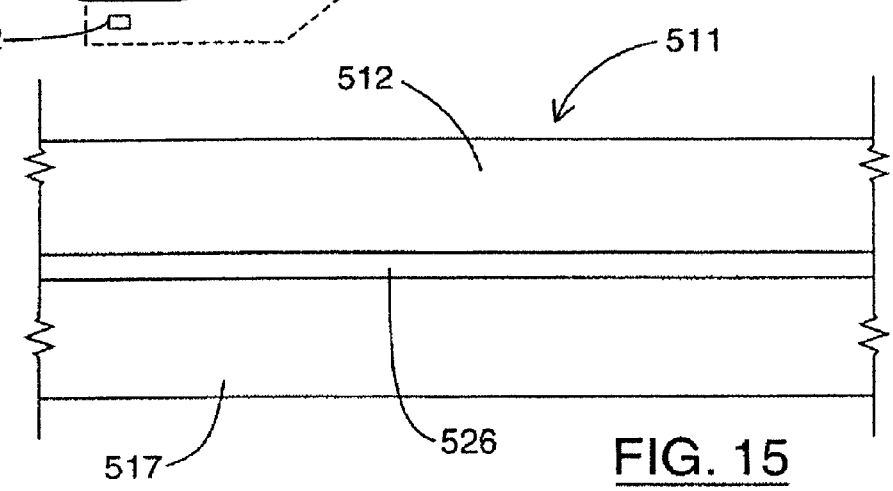
FIG. 15 is a top view of a handrail which forms part of the illumination system of FIG. 14.
Figure 16:
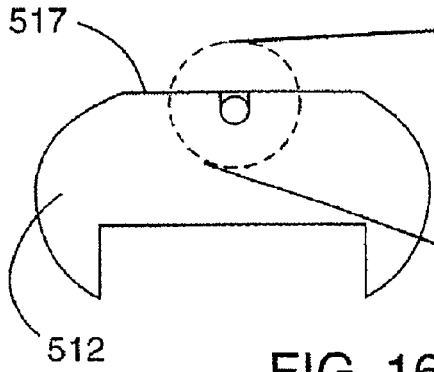
FIG. 16 is a sectional view of the handrail of FIG. 15.
Figure 17:
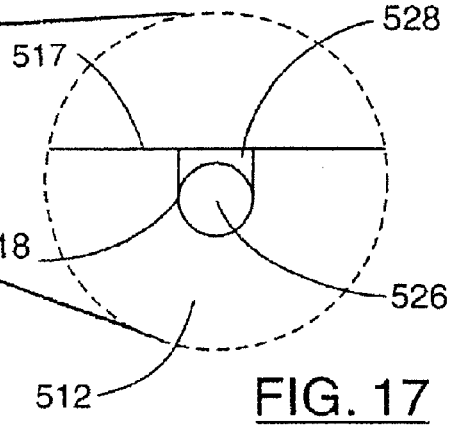
FIG. 17 is an enlargement of a portion of FIG. 16.

Reference is next made to FIGS. 11, 12 and 13, which illustrates a fifth embodiment of a handrail 412 which is part of an illumination system 411 according to the present invention. Elements of illumination system 411 which correspond to elements of illumination system 11 are given similar reference numerals increased by 400. Illumination system 411 differs from illumination systems 11 in that illumination system 411 does not require charging stations 38 (FIG. 1) or a power light block 19 (FIG. 2).

Illumination system 411 includes a handrail 412 and two light sources 492 and 494. Light sources 492 and 493 are positioned at the upper and lower ends of enclosed region 414. Handrail 412 comprises a base 416, a cover 428 and a luminescent message 496. Handrail 412 has a channel 418 which may be formed during manufacturing of handrail 412.

Luminescent message 496 is formed within channel 418. Luminescent message 496 is made of a luminescent material 498 which may be made to glow. One such luminescent material is sold by Hirotec Inc. 2470-G South Harbor Blvd, Santa Ana, Calif., USA under the trade mark PERMA-GLOW. This material is described on the Internet at www-.permaglow.com. This luminescent material is responsive to an energy input and begins to glow if it receives sufficient energy from an energy source such as a light source. If luminescent material 498 is produced in a paint form, luminescent message 496 may be formed by stenciling, painting or printing luminescent material 498 onto channel 418. Other methods may be used, depending on the nature of luminescent material 498. For example, a luminescent material formed into a sheet may be cut into letters or symbols, which may then be fastened (i.e. by glue or other means) onto channel 418. Luminescent material 498 may include different types of luminescent materials and different colors of luminescent materials.

Cover 428 is affixed to base 416 over channel 418 to protect luminescent message 496. In an alternative embodiment of a handrail according to this invention, channel 418 may be omitted. In such an embodiment luminescent message 496 may be formed on the top surface 417 of handrail 412 and cover 428 may be omitted or affixed onto top surface 417. This is similar to the structure of handrail 212.

Light sources 492 and 494 are selected to individually provide sufficient light energy to luminescent material 498 to cause it to glow. For example, if the PERMAGLOW material described above is used as luminescent material 498, light sources 492 and 494 may be high intensity (i.e. 300W) mercury vapor lamps. Light sources 492 and 494 may be selected so that they may be operated at a high intensity (i.e. 300 W or higher) and at a low intensity (i.e. a selected fraction of the high intensity).

Handrail 412 may travel around its closed path (shown in FIG. 11) in either direction, depending on whether escalator 410 is configured to carry riders up or down. When escalator 410 is configured to go up, handrail 412 will exit enclosed region 414 at its bottom, near light source 492. When escalator 410 is configured to go down, handrail 412 will exit enclosed region 414 at its top, near light source 494. In either case, the light source 492 or 494 adjacent the end of enclosed region 414 from which handrail 412 will exit enclosed region 414 is energized to provide light energy to luminescent material 498. The other light source 494 or 492 need not be energized.

Depending on the nature of luminescent material 498, it may be necessary to initially expose luminescent material 498 to a high power energy source to initiate the luminescence of luminescent material 498. Subsequently, a lower power energy source may be sufficient to maintain the luminescence of luminescent material 498. If this is required, light source 492 or 494 may be operated at a high intensity when escalator 410 is initially activated. When luminescent material 498 has received sufficient energy, light source 492 or 494 may be operated at a low intensity. To reduce the time required for luminescent material to receive sufficient energy, both light sources 492 and 494 may be used at high intensity during the initial period. In addition, both light sources 492 and 494 may be used at all times, possibly at a lower intensity, to maintain the luminescence of luminescent material 498.

Illumination system 411 provides a simple method for printing a luminescent message 496 onto an escalator handrail and using an external energy source (light source 492 and/or 494) to energize the luminescent message 496. This embodiment may be particularly appropriate for use with an escalator handrail that should be illuminated in low lighting situations. For example, this system may be appropriate for use in an office tower in the evening or nighttime hours, during which the main lighting of the building may be shut off.

In another embodiment of a handrail illumination system (not shown) according to the present invention, a luminescent material, such as the luminescent material 498 of handrail 411 may be mixed into the rubber or thermoplastic material from which the handrail is formed. This may be done prior to the formation of the handrail to provide a uniform mixture. When the handrail is formed, the luminescent component of the handrail may be made luminescent in the manner described above in relation to illumination system 411.

Reference is next made to FIGS. 14, 15, 16 and 17, which illustrate another embodiment of a handrail illumination system 511 according to the present invention. Illumination system 511 includes a handrail 512 and light sources 592 and 594. Handrail 512 has an optical fiber 526 embedded into a channel 518 adjacent its top surface 517. A cover 528 is affixed over optical fiber 526 to protect optical fiber 526 and to hold it in place within channel 518. Optical fiber 526 extends around the perimeter of handrail 512. The ends of optical fiber 526 are spliced together so that it forms a continuous loop. Optical fiber 526 may be comprised of several component fibers which are spliced together.

Light sources 592 and 594 are positioned at the upper and lower ends of enclosed region 514. Each light source 592, 594 provides a high intensity light beam which is directed into the portion of optical fiber 526 adjacent that light source. Light received by optic fiber 526 may be said to be "injected" into optic fiber 526. A least a portion of this injected light travels longitudinally in optic fiber 526, thereby causing optic fiber 526 to appear illuminated. If optic fiber 526 is selected to disperse light from it sides (as described above in relation to optic fiber 26), then this appearance of illumination may be enhanced. The use of two light sources 592 and 594 at the upper and lower ends of enclosed region 514 is desirable to increase the intensity of light emitted from optic fiber 526 and to maintain a more even intensity of light emitted along the length of optic fiber 526. However, one of light source 592 or light source 594 may be omitted.

Illumination system 511 has the advantage that no electronic components are required in handrail 512 and accordingly, there is no need to provide a battery or charging circuit in handrail 512.

Figure 18:
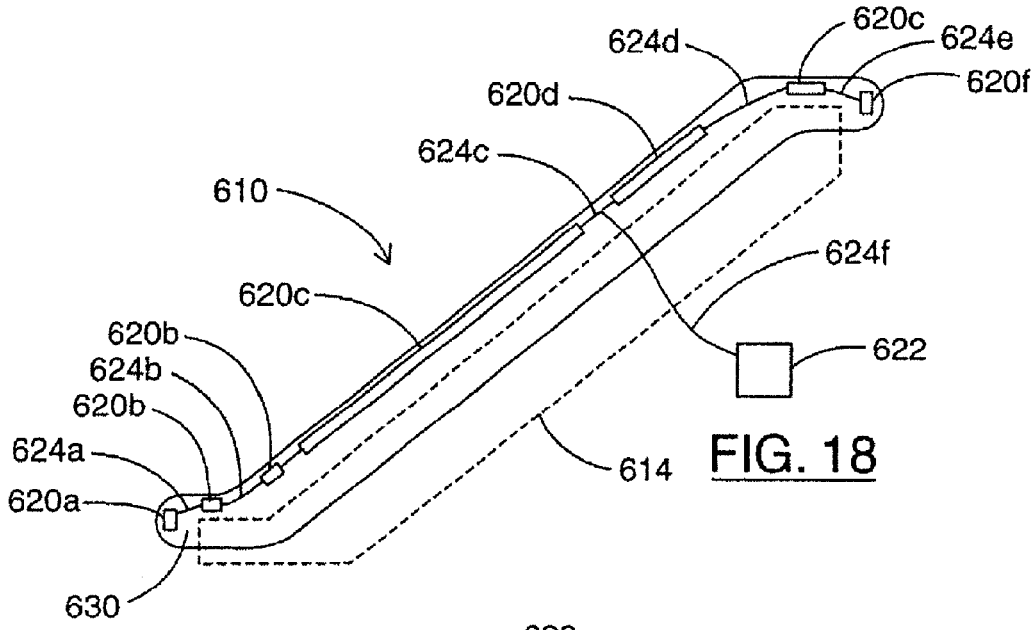
FIG. 18 is a side elevational view of a seventh illumination system according to the present invention.
Figure 19:
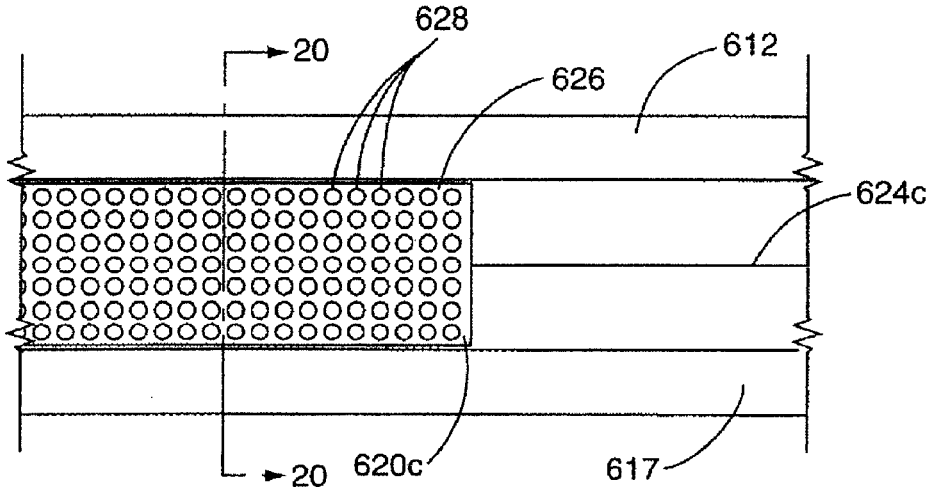
FIG. 19 is a top view of a handrail and a frame which form parts of the illumination system of FIG. 18.
Figure 20:
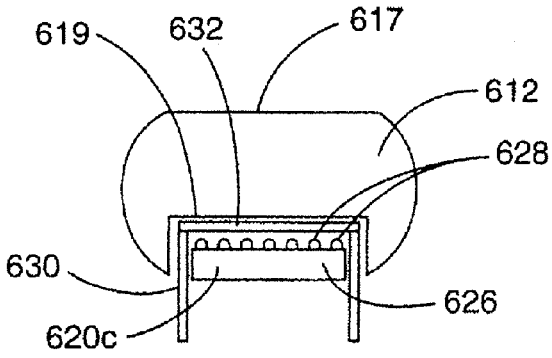
FIG. 20 is a sectional view of the handrail and frame of FIG. 19.

Reference is next made to FIGS. 18, 19 and 20, which illustrate another embodiment of a handrail illumination system 611. System 611 comprises a handrail 612 and a plurality of sign boards 620*a*–620*f* and a controller 622. Sign boards 620*a*–620*f* and controller 622 are coupled together by couplings 624*a*–624*f*.

Part of sign board 620*c* is illustrated in FIGS. 19 and 20. Sign board 620*c* has a housing 626 and a plurality of light sources 628 extending from the housing 626. Light sources 628 may be single or mulit-color LEDs, light bulbs or any other type of light emitting device. Light sources 628 are controlled by controller 622 through couplings 624. Controller 622 may be a computer or other type of control device. Typically, each sign board 620 may be an independent unit capable of receiving control instructions from controller 622 and of displaying text or graphic messages using light sources 628. Sign board 620*c* has its lights source 628 arranged in a matrix that is particularly suitable for displaying text, which may be displayed in a static or moving position.

Light sources 628 may receive power from the electrical system of escalator 610 or from another source (not shown) in a conventional manner. Since sign boards 620 are mounted in fixed positions within the frame 630 of escalator 610, they be physically coupled to a power source and do not require batteries or charging circuits.

The bottom surface 619 of handrail 312 is supported by a frame 630, which is part of the body of escalator 610. Frame 630 has a transparent cover 632, which permits light from light sources 628 to pass through to the bottom surface 617 of handrail 612. Each sign board 620 is installed within frame 630 adjacent to handrail 612, so that the light from the sign board's light sources 628 is directed to the bottom surface 617 of handrail 612.

Handrail 612 is formed from a transparent material, allowing text or images displayed on sign boards 620 to be viewed through the top surface 617 of handrail 612. In this way, a text or graphic message displayed using light sources 628 is visible through the top surface 617 of handrail 612.

Illumination system 611 includes six sign boards 620*a*–620*f* of various sizes and placed in different parts of frame 630. In an alternative embodiment, a single sign board that extends the whole or part of the exposed portion of handrail 612 (i.e. the portion of handrail 612 that is not enclosed within the body of escalator 610 at any particular time) may be used. Alternatively, independent light sources may be installed within frame 630. Such independent light sources may optionally be organized in a matrix like light sources 628 and may optionally be controlled by a common controller like controller 622. Alternatively, such independent light sources may be controlled by separate controllers or may simply be left on at all times. Any other method of directing light on to the bottom surface 619 of handrail 620 may be used within the scope of the present invention.

Handrail 612 has been described as transparent. Alternatively, handrail 612 may be formed from a translucent colored or colorless material. In a simple embodiment, a translucent handrail 612 that diffuses light may be combined with several constantly powered light sources 628 spaced along the path of handrail 612 to simply illuminate the handrail 612. Such a system may be used to illuminate the entire exposed part of handrail 612 or may be used to illuminate only the portion of the handrail 612 at the top and/or bottom of the escalator 610.

Handrail illumination system 611 allows transparent or translucent handrail 612 to be illuminated through its bottom surface. If handrail 612 is transparent and appropriate light sources, such as sign boards 620 are used, a text or graphic message may be displayed through handrail 612. Handrail illumination system 611 does not require a channel, such as channel 18 to be formed in handrail 612. In addition, no electronic components are required in handrail 612, eliminating the need for batteries and charging stations.

Illumination systems 11, 111, 211, 311, 411, 511 and 611 have been described in the context of a single handrail. As is well known, most escalators have two distinct handrails and an illumination system may be used on one or both of such handrails. Furthermore, differently configured illumination systems may be used on one or both handrails to increase the amount of safety or advertising information which may be conveyed.

While particular embodiments of illumination systems according to the present invention have been described here, other variations are possible. Such variations fall within the scope of the invention, which is limited only by the appended claims.

We claim:

1. An illumination system for a moving handrail, said illumination system comprising:

(a) a light source attached to said moving handrail; and (b) a power source comprising a first circuit coupled to said light source, and a second circuit, wherein the light source and the first circuit are mounted to the moving handrail, wherein the second circuit is stationary, and wherein electromagnetic coupling is provided between the first and second circuits for transferring power therebetween.

2. The illumination system of claim 1 wherein a channel is formed in a top surface of said handrail and wherein said light source is mounted within said channel.

3. The illumination system of claim 2 further comprising a cover mounted over said channel.

4. The illumination system of claim 3 further comprising one or more support shells positioned within said channel wherein said shells have a thickness which substantially fills the depth of said channel around said light source and beneath said cover, to support said cover.

5. The illumination system of claim 4 wherein a plurality of said support shells are provided at intervals along said channel, and wherein an optically transparent material is provided between adjacent support shells.

6. The illumination system of claim 1 wherein said light source mounted to an upper surface of said moving handrail from above.

7. The illumination system of claim 1 wherein said light source comprises a light dispersing optic fiber.

8. The illumination system of claim 1 wherein said light source is a light emitting diode.

9. The illumination system of claim 1 wherein said light source is a laser.

10. The illumination system of claim 1 further comprising a light dispersing element and wherein said light source is comprised of a light emitting diode.

11. The illumination system of claim 10 wherein said light dispersing element is a light dispersing optic fiber.

12. The illumination system of claim 10 wherein said light dispersing element is a sheet of flexible plastic.

13. The illumination system of claim 12 wherein said sheet of flexible plastic is engraved or etched with a graphic image or message.

14. The illumination system of claim 12 wherein a graphic image or message is printed onto said sheet of flexible plastic with photo-luminescent paint.

15. The illumination system of claim 1 wherein said power source comprises a rechargeable battery and said rechargeable battery is attached to said moving handrail.

16. The illumination system of claim 15 comprising:

(i) a charging circuit coupled to said battery for charging said battery in response to a charging signal; and (ii) a power supply circuit for generating said charging signal, wherein said power supply circuit and charging circuit are electromagnetically coupled for transmitting said charging signal from said power supply circuit to said charging circuit.

17. The illumination system of claim 16 including at least two power supply circuits wherein said handrail travels along a closed path and wherein said at least two power supply circuits are positioned adjacent said path and are spaced along said path to allow said charging circuit to be electromagnetically coupled to each said power supply circuit.

18. The illumination system of claim 1 wherein said handrail travels along a closed path and wherein a portion of said path is enclosed and further including a position detection device for de-activating said light source when said light emitting device is in said enclosed portion of said path.

19. An illumination system for a moving handrail comprising:

(a) an optic fiber mounted to said moving handrail; and (b) a light source for injecting light into said optic fiber, wherein said optic fiber is configured to absorb at least some of said injected light and to disperse at least some of said absorbed light through a side surface of said optic fiber, and wherein said dispersed light travels through a top surface of said moving handrail.

20. The illumination system of claim 19 wherein said light source is spaced apart from said optic fiber and from said handrail.

21. The illumination system of claim 19 wherein said handrail is moveably mounted on a support frame and wherein said light source is fixedly mounted on said support frame.

22. An illumination system for moving handrail comprising at least one light source oriented to direct light onto a bottom surface of said moving handrail, wherein the handrail includes a light receiving and emitting portion, adapted to receive and absorb light from the light source and to emit light, whereby, in use, light is emitted from the handrail and is visible from a top surface of said handrail.

23. The illumination system of claim 22 wherein said handrail is translucent.

24. The illumination system of claim 22, wherein said handrail is transparent and wherein said at least one light source is mounted adjacent said bottom surface of aid handrail.

25. An illumination system for a moving handrail and having a light source comprising a plurality of individual light sources arranged in a matrix, wherein said matrix defines an electronic signboard directed at the handrail.

26. The illumination system of claim 25 further comprising a controller for controlling the operation said electronic signboard.

27. The illumination system of claim 26 wherein said electronic signboard displays at least one of text and graphics.

* * * * *